US010562303B2

(12) United States Patent
Higashibeppu

(10) Patent No.: US 10,562,303 B2
(45) Date of Patent: Feb. 18, 2020

(54) NOZZLE MEMBER, LIQUID EJECTION HEAD INCLUDING NOZZLE MEMBER, AND RECORDING DEVICE

(71) Applicant: KYOCERA Corporation, Kyoto-shi, Kyoto (JP)

(72) Inventor: Makoto Higashibeppu, Kyoto (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 16/072,894

(22) PCT Filed: Jan. 27, 2017

(86) PCT No.: PCT/JP2017/002987
§ 371 (c)(1),
(2) Date: Jul. 26, 2018

(87) PCT Pub. No.: WO2017/131178
PCT Pub. Date: Aug. 3, 2017

(65) Prior Publication Data

US 2019/0039374 A1 Feb. 7, 2019

(30) Foreign Application Priority Data

Jan. 28, 2016 (JP) ..... 2016-014546

(51) Int. Cl.
*B41J 2/14* (2006.01)
*B41J 2/16* (2006.01)

(52) U.S. Cl.
CPC ..... *B41J 2/1433* (2013.01); *B41J 2/14* (2013.01); *B41J 2/14201* (2013.01);
(Continued)

(58) Field of Classification Search
CPC ..... B41J 2/14; B41J 2/14201; B41J 2/14209; B41J 2/1433; B41J 2/1606; B41J 2/162; B41J 2/1625; B41J 2/1631; B41J 2/1632; B41J 2/1634; B41J 2/1643; B41J 2/1646; B41J 2202/14225; B41J 2202/20; B41J 2202/21
See application file for complete search history.

(56) References Cited

U.S. PATENT DOCUMENTS

2010/0214354 A1 8/2010 Ohshiba
2011/0069117 A1* 3/2011 Ohzeki ..... B41J 2/1433 347/44
(Continued)

FOREIGN PATENT DOCUMENTS

JP 2003-341070 A 12/2003
JP 2006-082445 A 3/2006
(Continued)

*Primary Examiner* — Anh T Vo
(74) *Attorney, Agent, or Firm* — Volpe and Koenig, P.C.

(57) ABSTRACT

A nozzle member includes a base, a metal oxide film, and a water-repellent film. The base includes a first surface having a plurality of through-holes as ejection orifices. The metal oxide film is located on the first surface. The water-repellent film is located on the metal oxide film. The metal oxide film has a greater thickness in a first area than in a second area. The first area is an area surrounding each ejection orifice. The second area is an area between adjacent first areas.

15 Claims, 8 Drawing Sheets

(52) U.S. Cl.
CPC ..... *B41J 2/14209* (2013.01); *B41J 2/162* (2013.01); *B41J 2/1606* (2013.01); *B41J 2/1625* (2013.01); *B41J 2/1631* (2013.01); *B41J 2/1632* (2013.01); *B41J 2/1634* (2013.01); *B41J 2/1643* (2013.01); *B41J 2/1646* (2013.01); *B41J 2002/14225* (2013.01); *B41J 2202/20* (2013.01); *B41J 2202/21* (2013.01)

(56) References Cited

U.S. PATENT DOCUMENTS

| | | | | |
|---|---|---|---|---|
| 2013/0120485 | A1* | 5/2013 | Kodama ..... | B41J 2/04508 347/14 |
| 2013/0235120 | A1 | 9/2013 | Hirabayashi et al. | |

FOREIGN PATENT DOCUMENTS

| | | | |
|---|---|---|---|
| JP | 2007-136789 | A | 6/2007 |
| JP | 2011-189641 | A | 9/2011 |
| JP | 2015-191931 | A | 11/2015 |

* cited by examiner

NOZZLE MEMBER, LIQUID EJECTION HEAD INCLUDING NOZZLE MEMBER, AND RECORDING DEVICE

FIELD

The disclosure relates to a nozzle member, a liquid ejection head including the nozzle member, and a recording device.

BACKGROUND

A known nozzle member for a liquid ejection head includes a $SiO_2$ film between a base and a fluorocarbon water repellent (refer to, for example, Patent Literature 1).

CITATION LIST

Patent Literature

Patent Literature 1: Japanese Unexamined Patent Application Publication No. 2003-341070

BRIEF SUMMARY

A nozzle member according to an aspect of the disclosure includes a base, a metal oxide film, and a water-repellent film. The base includes a first surface having a plurality of through-holes as ejection orifices. The metal oxide film is located on the first surface. The water-repellent film is located on the metal oxide film. The metal oxide film has a greater thickness in a first area than in a second area. The first area is an area surrounding each ejection orifice. The second area is an area between adjacent first areas.

A nozzle member according to another aspect of the disclosure includes a base, a metal oxide film, and a water-repellent film. The base includes a first surface having a plurality of through-holes as ejection orifices. The metal oxide film is located on the first surface. The water-repellent film is located on the metal oxide film. The metal oxide film has a greater surface roughness in a first area than in a second area at a surface of the metal oxide film adjacent to the water-repellent film. The first area is an area surrounding each ejection orifice. The second area is an area between adjacent first areas.

A liquid ejection head according to an aspect of the disclosure includes the nozzle member according to any one of the above aspects, a pressurizing chamber communicating with each ejection orifice, and a pressurizer that pressurizes the pressurizing chamber.

A recording device according to an aspect of the disclosure includes the above liquid ejection head, a transport unit that transports a recording medium to the liquid ejection head, and a controller that controls the liquid ejection head.

DETAILED DESCRIPTION

A known nozzle member includes a water-repellent film on its surface to prevent the ejection performance from deteriorating due to liquid adhesion to the surface near nozzles. However, removing the liquid on the nozzle member surface by, for example, wiping may reduce the water repellency of the surface near the nozzles, and may degrade the ejection performance. This difficulty is reduced by a nozzle member according to the disclosure. The nozzle member, a liquid ejection head, and a recording device according to the disclosure will now be described in detail with reference to the drawings.

Figure 1A:
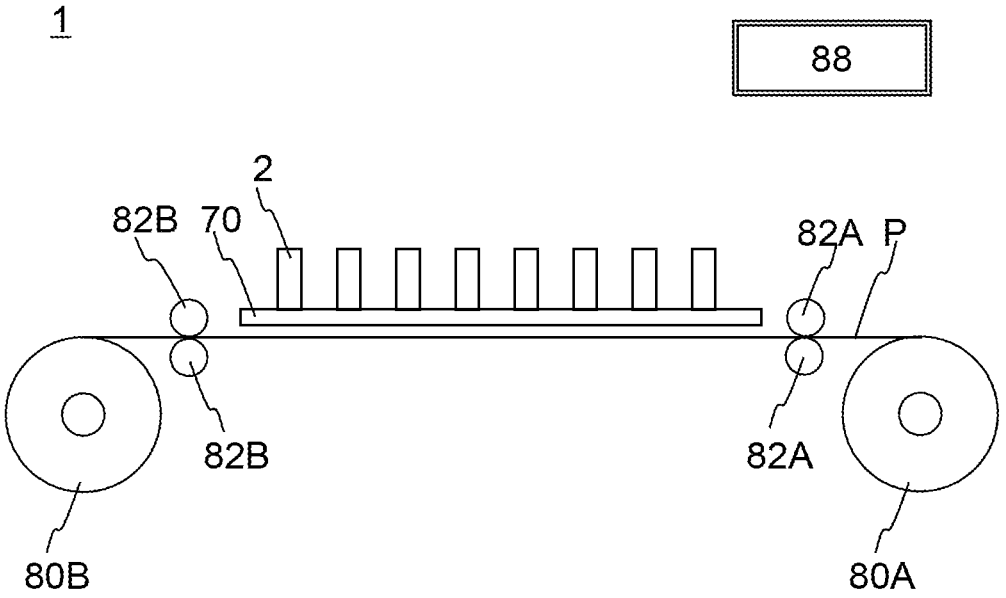
FIG. 1A is a side view of a recording device according to one embodiment of the disclosure.
Figure 1B:
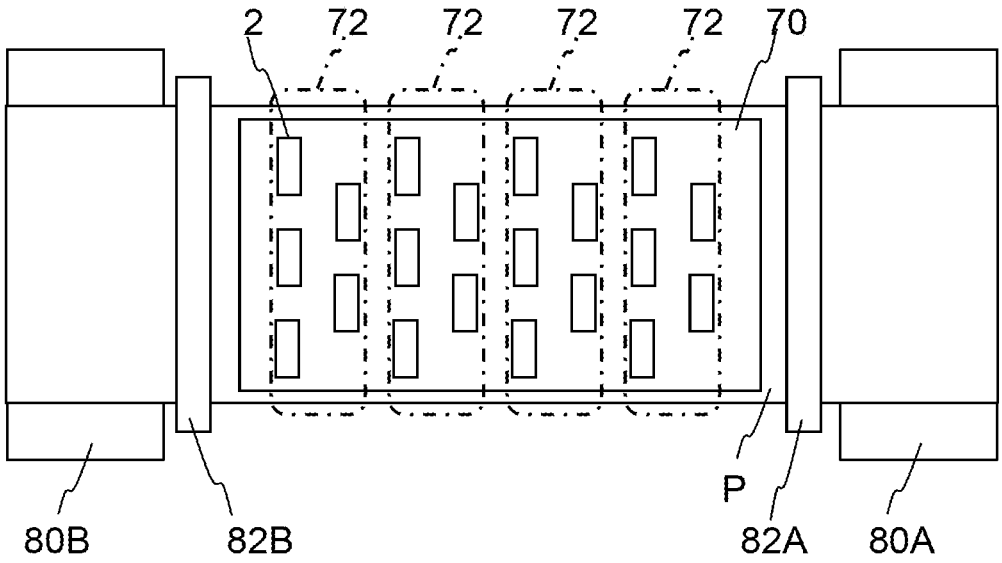
FIG. 1B is a plan view of the recording device according to one embodiment of the disclosure.

FIG. 1A is a schematic side view of a color inkjet printer 1 (hereinafter also simply the printer 1), which is one example of the recording device according to the disclosure. FIG. 1B is a schematic plan view of the printer 1. The printer 1 transports print paper P, which is a recording medium, from guide rollers 82A to transport rollers 82B to move the print paper P relative to liquid ejection heads 2. The printer 1 controls the liquid ejection heads 2 using a controller 88 to eject a liquid in droplets from the liquid ejection heads 2 to the print paper P based on data about images or text. In this manner, the printer 1 records the data on the print paper P by, for example, printing.

In the present embodiment, the liquid ejection heads 2 are fixed to the printer 1, which is a line printer. However, the printer 1 may be any other printer. For example, the printer 1 may be a serial printer that alternately transports the print paper P and moves the liquid ejection heads 2 in a direction crossing the transport direction of the print paper P, or for example reciprocates the liquid ejection heads 2 in a direction substantially perpendicular to the transport direction.

A flat head mount frame 70 (hereafter also simply the frame 70) is fixed to the printer 1, and extends substantially parallel to the print paper P. The frame 70 has twenty holes (not shown) in which the twenty liquid ejection heads 2 are mounted. Each liquid ejection head 2 has a liquid ejection part facing the print paper P. The distance between the liquid ejection head 2 and the print paper P ranges from, for example, about 0.5 to 20 mm. In the example shown in FIGS. 1A and 1B, five out of twenty liquid ejection heads 2 form one head group 72, and the printer 1 has four head groups 72.

Each liquid ejection head 2 is elongated in a direction from the near side to the far side in FIG. 1A, or in the vertical direction in FIG. 1B. This direction may be referred to as a longitudinal direction. Each head group 72 includes three liquid ejection heads 2 arranged in the direction crossing the transport direction of the print paper P in, for example, the direction substantially perpendicular to the transport direction. The remaining two liquid ejection heads 2 in each head group 72 are spaced from the three liquid ejection heads 2 in the transport direction to cover spaces between the three liquid ejection heads 2. The liquid ejection heads 2 allow continuous and entire printing of the print paper P in the widthwise direction (in the direction crossing the transport direction of the print paper P) or have their ends overlapping each other. Thus, the liquid ejection heads 2 can perform continuous printing on the print paper P without leaving any blanks in the widthwise direction.

The four head groups 72 are arranged in the transport direction of the print paper P. Liquid, which is for example ink, is supplied to each liquid ejection head 2 from a liquid tank (not shown). The ink of the same color is supplied to the liquid ejection heads 2 in the same head group 72. The four head groups 72 thus enable printing with four colors of ink. The colors of ink ejected from the head groups 72 are, for example, magenta (M), yellow (Y), cyan (C), and black (K). The controller 88 controls printing with ink of such colors to print a color image.

The printer 1 may include a single liquid ejection head 2 for printing a monochrome image over an area printable by the single liquid ejection head 2. The number of liquid ejection heads 2 in each head group 72 or the number of head groups 72 may be changed in accordance with an object to be printed or the printing conditions. For example, the printer 1 may include more head groups 72 for printing with more colors. The printer 1 may include multiple head groups 72 for printing with the same color alternately printing in the transport direction to accelerate transportation with the liquid ejection heads 2 having the same capabilities. This structure can increase the printable area per unit time. In some embodiments, multiple head groups 72 for printing with the same color may be spaced from one another in the direction crossing the transport direction to increase the resolution in the widthwise direction of the print paper P.

Moreover, the printer 1 may be used to treat the surface of the print paper P with a liquid such as a coating agent, instead of printing colored ink printed on the surface.

The printer 1 prints on the print paper P, which is a recording medium. The print paper P is wound around a feed roller 80A. The print paper P passes between two guide rollers 82A, then under the liquid ejection heads 2 mounted on the frame 70, between two transport rollers 82B, and is finally rewound by a rewind roller 80B. For printing, the print paper P is transported by rotating the transport rollers 82B at a constant speed, and undergoes printing with the liquid ejection heads 2. The rewind roller 80B rewinds the print paper P fed from the transport rollers 82B. Thus, the feed roller 80A, the guide rollers 82A, the transport rollers 82B, and the rewind roller 80B form a transport unit that transports the print paper P to the liquid ejection heads 2. The transport speed is, for example, 75 m/min. Each roller may be controlled by the controller 88 or manually by an operator.

The recording medium may be a roll of cloth, instead of the print paper P. The printer 1 may directly transport a transport belt carrying recording media, instead of directly transporting the print paper P. The recording media may be materials such as cut sheets of paper, or cut pieces of cloth, wooden sheets, or tiles. The liquid ejection heads 2 may eject a liquid containing electrically conductive particles to print a wiring pattern of an electronic device. The liquid ejection heads 2 may further eject a predetermined amount of liquid chemical agent or liquid containing a chemical agent to, for example, a reaction container to produce chemicals through reactions for example.

The printer 1 may include, for example, a position sensor, a speed sensor, or a temperature sensor, which are used by the controller 88 to control the components of the printer 1 in accordance with the states of the components determined using information from each sensor. For example, when the ejection performance including the amount of liquid ejected or the speed at which the liquid is ejected is affected by information about the ejection including the temperature of the liquid ejection heads 2, the temperature of the liquid in the liquid tank, and the pressure of the liquid in the liquid tank applied to the liquid ejection heads 2, the controller 88 may change driving signals for ejecting the liquid in accordance with the information.

The recording device according to the disclosure may be any recording device including liquid ejection heads and a transport unit that transports a recording medium to the liquid ejection heads. The recording device may include any other components. The transport unit may also include any components other than described in the present embodiment.

Figure 2:
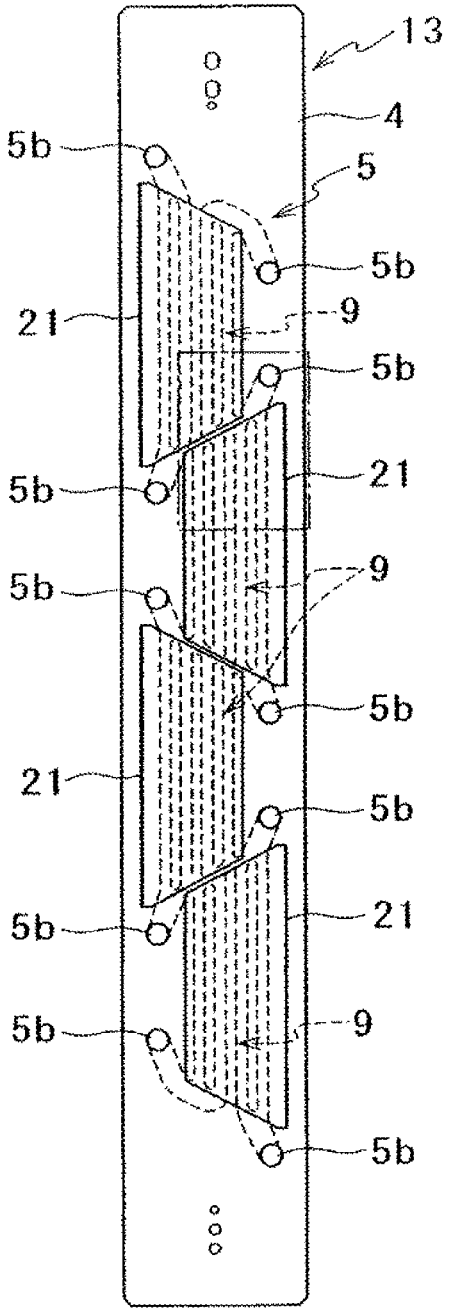
FIG. 2 is a plan view of a head body included in a liquid ejection head shown in FIGS. 1A and 1B.
Figure 3:
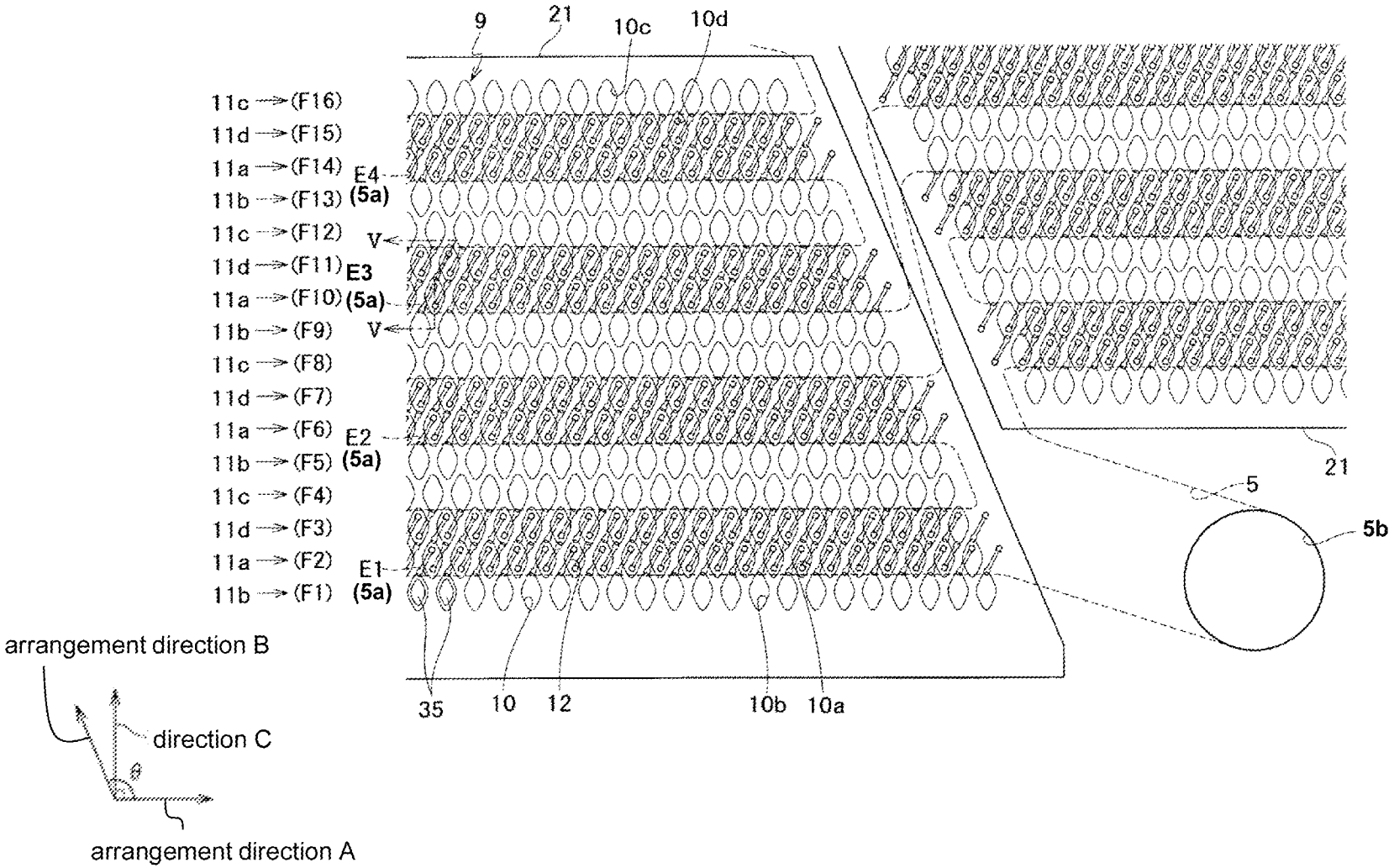
FIG. 3 is an enlarged view of an area indicated by the dot-and-dash line in FIG. 2, excluding some flow channels for illustration purposes.
Figure 4:
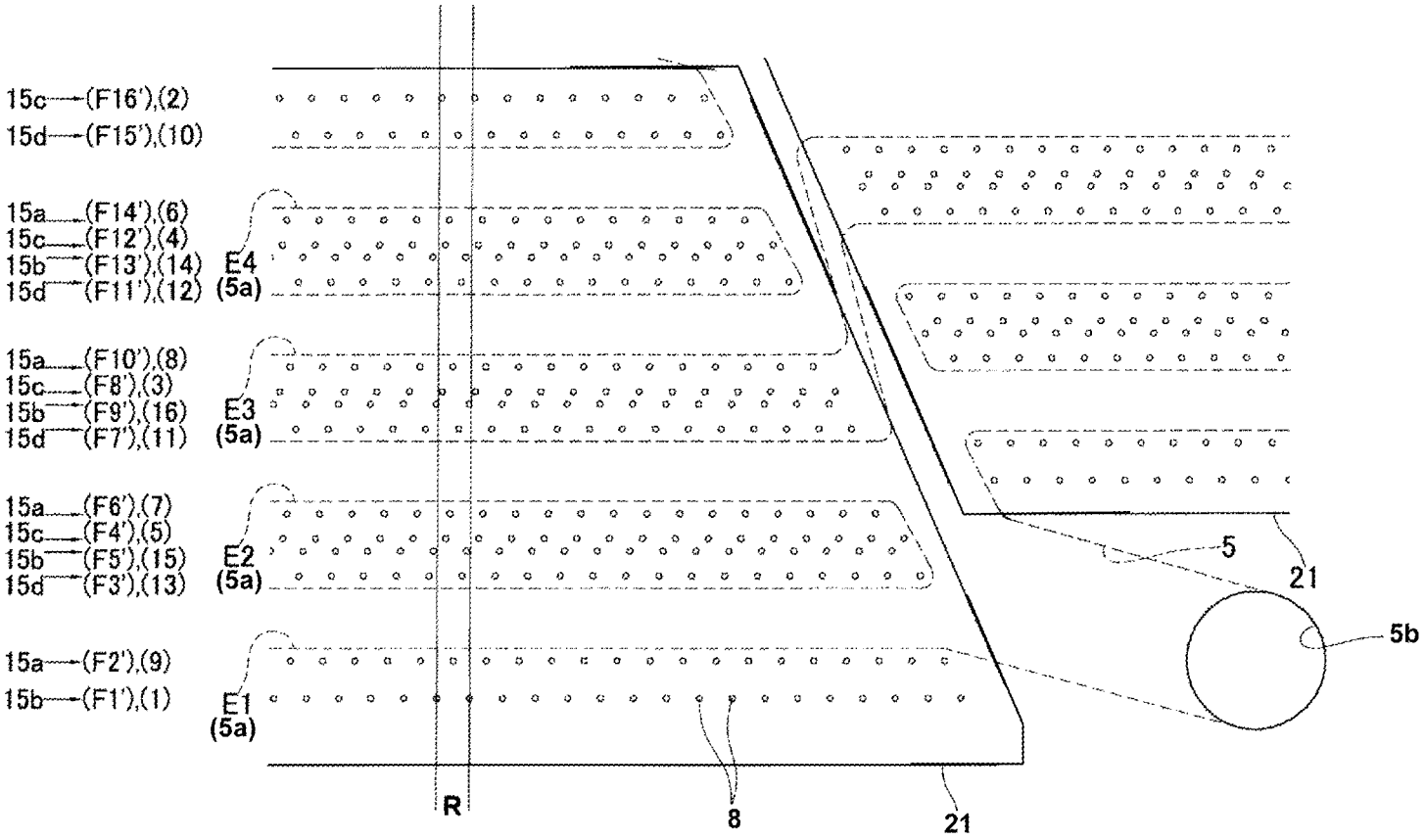
FIG. 4 is an enlarged view of the area indicated by the dot-and-dash line in FIG. 2, excluding some flow channels for illustration purposes.
Figure 5A:
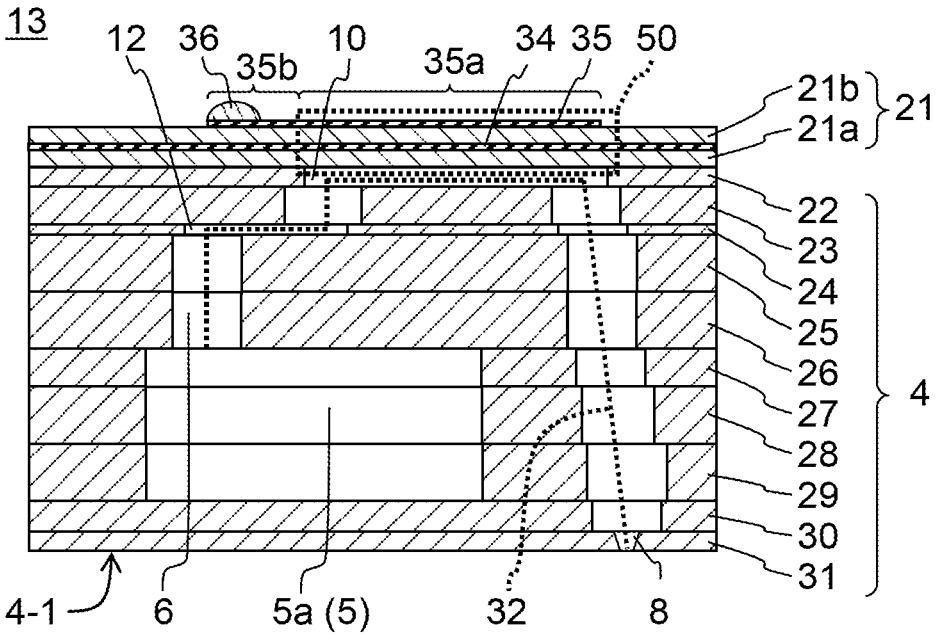
FIG. 5A is a cross-sectional view taken along line V-V in FIG. 3.
Figure 5B:
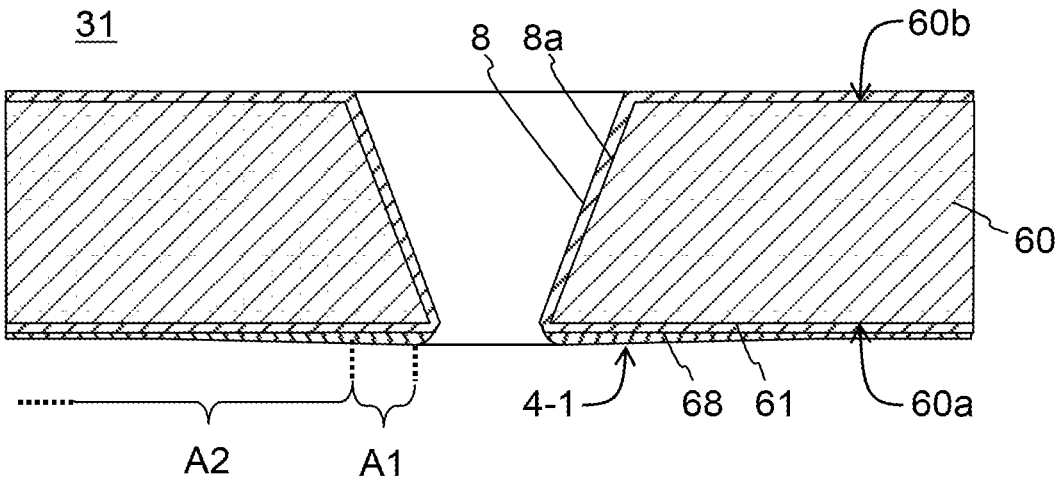
FIG. 5B is a cross-sectional view of a part including an ejection orifice 8 in FIG. 5A.
Figure 5C:
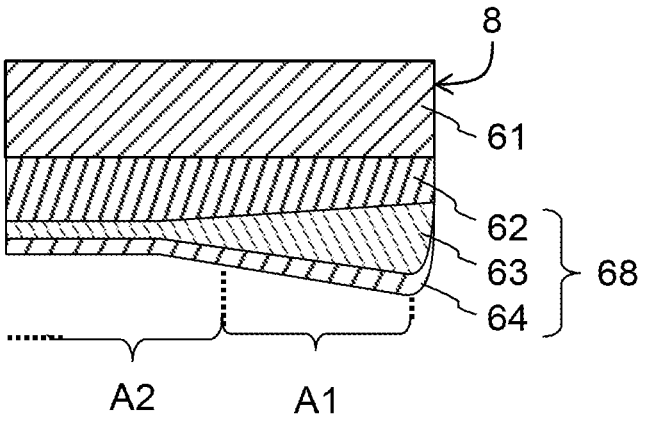
FIG. 5C is an enlarged cross-sectional view of a part of FIG. 5B.

The liquid ejection head 2, which is one example of the liquid ejection head according to the disclosure, will now be described. FIG. 2 is a plan view of a head body 13 of the liquid ejection head 2, which is a main part of the liquid ejection head 2 shown in FIGS. 1A and 1B. FIG. 3 is an enlarged plan view of the area indicated by the dot-and-dash line in FIG. 2, showing a part of the head body 13. FIG. 4 is an enlarged plan view of the same part as shown in FIG. 3. To simplify the drawings, FIGS. 3 and 4 do not show some channels. For illustration purposes in FIGS. 3 and 4, components located under a piezoelectric actuator substrate 21, such as pressurizing chambers 10, apertures 12, and ejection orifices 8, are drawn with solid lines, instead of broken lines. FIG. 5A is a cross-sectional view taken along line V-V in FIG. 3. FIG. 5B is an enlarged cross-sectional view of a part including an ejection orifice 8 in FIG. 5A. FIG. 5C is a further enlarged cross-sectional view of a part of FIG. 5B.

The head body 13 includes a flat channel 4 and piezoelectric actuator substrates 21 located on the channel 4. The channel 4 includes a nozzle plate 31, which is a nozzle member having ejection orifices 8, and plates 22 to 30 stacked on one another. The piezoelectric actuator substrates 21, which are trapezoidal, are arranged on the upper surface of the channel 4 with the facing parallel sides of the trapezoid of each substrate parallel to the longitudinal direction of the channel 4. The four piezoelectric actuator substrates 21 are arranged on the channel 4 in a staggered manner, in which two piezoelectric actuator substrates 21 in each pair are along two imaginary lines parallel to the longitudinal direction of the channel 4. The oblique sides of the piezoelectric actuator substrates 21 adjacent to one another on the channel 4 partially overlap in the lateral direction of the channel 4. When the piezoelectric actuator substrates 21 are driven to print an image, droplets ejected from the adjacent two piezoelectric actuator substrates 21 having their oblique sides overlapping in the lateral direction are mixed and applied in the same area of the image.

The channel 4 has manifolds 5, which are parts of liquid channels. The manifolds 5 are elongated in the longitudinal direction of the channel 4. The channel 4 has openings 5*b* of the manifolds 5 in the upper surface. The openings 5*b* are ten openings in total, or specifically two sets of five openings arranged correspondingly on two straight lines (imaginary lines) parallel to the longitudinal direction of the channel 4. The openings 5*b* are located in areas other than the areas in which the four piezoelectric actuator substrates 21 are arranged. A liquid is supplied from a liquid tank (not shown) to the manifolds 5 through the openings 5*b*.

Each manifold 5 in the channel 4 diverges into multiple sections (such diverging sections of each manifold 5 may also be referred to as sub-manifolds 5*a*). Parts of each manifold 5 continuous to the openings 5*b* extend along the oblique sides of the piezoelectric actuator substrates 21 to cross the longitudinal direction of the channel 4. In an area between two piezoelectric actuator substrates 21, one manifold 5 is shared with the adjacent piezoelectric actuator substrates 21, and has sub-manifolds 5*a* diverging from both sides of the manifold 5. These sub-manifolds 5*a* extend adjacent to one another in the longitudinal direction of the head body 13 in the area inside the channel 4, which corresponds to the piezoelectric actuator substrates 21.

The channel 4 includes four pressurizing chamber groups 9, each of which includes a matrix of multiple pressurizing chambers 10 (arranged two-dimensionally regularly). Each pressurizing chamber 10 is a hollow space having a flat, substantially rhombus shape with rounded corners. Each pressurizing chamber 10 is open in the upper surface of the channel 4. The pressurizing chambers 10 are arranged substantially in the entire area of the upper surface of the channel 4 facing the piezoelectric actuator substrates 21. Each pressurizing chamber group 9 including the pressurizing chambers 10 uses the area having substantially the same size and the same shape as the area of the corresponding piezoelectric actuator substrate 21. The opening of each pressurizing chamber 10 is closed with the piezoelectric actuator substrate 21 bonded to the upper surface of the channel 4.

In the present embodiment, as shown in FIG. 3, the manifold 5 diverges into four rows E1 to E4 of sub-manifolds 5*a* arranged parallel to one another in the lateral direction of the channel 4. The pressurizing chambers 10 continuous with each sub-manifold 5*a* form a row of pressurizing chambers 10, which are arranged at equal intervals in the longitudinal direction of the channel 4. Four rows of the pressurizing chambers 10 are arranged parallel to one another in the lateral direction. Two rows of the pressurizing chambers 10 continuous with each sub-manifold 5*a* are arranged on each of the two sides of the sub-manifold 5*a*.

The pressurizing chambers 10 continuous with the manifolds 5 as a whole form sixteen rows of the pressurizing chambers 10, which are arranged at equal intervals in the longitudinal direction of the channel 4. The rows are arranged parallel to one another in the lateral direction. In correspondence with the contour of a displacement element 50 serving as an actuator, each pressurizing chamber row includes gradually fewer pressurizing chambers 10 from the longer side toward the shorter side.

Ejection orifices 8, which serve as nozzles, are arranged at substantially equal intervals of about 42 μm (25.4 mm/150=42 μm at 600 dpi) in the longitudinal direction, which is the resolution direction of the head body 13. Thus, the head body 13 can form images at a resolution of 600 dpi in its longitudinal direction. In the area where two piezoelectric actuator substrates 21 having a trapezoid shape overlap each other, the ejection orifices 8 under the two piezoelectric actuator substrates 21 are arranged complementarily to each other. Thus, the ejection orifices 8 are formed at the intervals corresponding to the resolution of 600 dpi in the longitudinal direction of the head body 13.

Individual channels 32 are connected to each sub-manifold 5*a* at intervals corresponding to the average resolution of 150 dpi. In designing the ejection orifices 8 for the resolution of 600 dpi to be connected to four separate rows of the sub-manifolds 5*a*, the individual channels 32 may not be connected at equal intervals to the sub-manifolds 5*a*. The individual channels 32 are thus arranged at average intervals smaller than or equal to 170 μm (25.4 mm/150=169 μm at 150 dpi) in the direction in which the sub-manifolds 5*a* extend, or in the main scanning direction.

Individual electrodes 35 (described below) are located on the upper surface of each piezoelectric actuator substrate 21 at the positions corresponding to the pressurizing chambers 10. Each individual electrode 35 is slightly smaller than the corresponding pressurizing chamber 10 and has the shape substantially similar to the shape of the pressurizing chamber 10 to fall within an area of the upper surface of the piezoelectric actuator substrate 21 corresponding to the pressurizing chamber 10.

Although FIG. 5A shows a single ejection orifice 8 in one example, a large number of ejection orifices 8 are open in an ejection orifice surface 4-1, which is the lower surface of the channel 4. The ejection orifices 8 are formed in areas other than the area corresponding to the sub-manifolds 5*a* nearer the lower surface of the channel 4. The ejection orifices 8 are formed in the lower surface of the channel 4 in the area corresponding to the piezoelectric actuator substrates 21. A group of ejection orifices 8, or each ejection orifice group, uses an area having substantially the same size and the same shape as the area of the corresponding piezoelectric actuator substrate 21. Droplets are ejected from the ejection orifices 8 by displacing the displacement elements 50 included in each piezoelectric actuator substrate 21. The ejection orifices 8 in each ejection orifice group are arranged at equal intervals along multiple straight lines parallel to the longitudinal direction of the channel 4.

The channel 4 included in the head body 13 has a stacked structure including multiple plates stacked on one another. These plates are, from the upper surface of the channel 4, a cavity plate 22, a base plate 23, an aperture plate 24, supply plates 25 and 26, manifold plates 27, 28, and 29, a cover plate 30, and a nozzle plate 31, which is a nozzle member. These plates have a large number of holes. These plates are aligned and stacked on one another to allow the holes to communicate with one another to define the individual channels 32 and the sub-manifolds 5*a*. As shown in FIG. 5A, the pressurizing chamber 10 is located in the upper surface of the channel 4, the sub-manifold 5*a* is located inside the channel 4 nearer the lower surface, and the ejection orifice 8 is located in the lower surface of the channel 4. In the channel 4, the parts defining each individual channel 32 are located adjacent to one another, and the sub-manifold 5*a* and the ejection orifice 8 are connected through the pressurizing chamber 10.

These plates have holes described below. The first is the pressurizing chamber 10 defined in the cavity plate 22. The second is a communication hole defining a channel extending between an end of the pressurizing chamber 10 and the sub-manifold 5*a*. This communication hole is formed through the base plate 23 (specifically the entrance of the pressurizing chamber 10) to the supply plate 25 (specifically the exit of the sub-manifold 5*a*). This communication hole includes the aperture 12 in the aperture plate 24, and an individual supply channel 6 in the supply plates 25 and 26.

The third is a communication hole defining a channel extending between the other end of the pressurizing chamber 10 and the ejection orifice 8. This communication hole is hereafter referred to as a descender (partial channel). The descender is formed through the base plate 23 (specifically the exit of the pressurizing chamber 10) to the nozzle plate 31 (specifically the ejection orifice 8). One end of the descender functions as the ejection orifice 8 with a particularly small cross-section formed in the nozzle plate 31. The surface of the nozzle plate 31 is covered with a plating film 61. The plating film 61 will be described later.

The fourth is a communication hole defining the sub-manifold 5*a*. This communication hole is formed through the manifold plates 27 to 29.

These holes communicate with each other to define the individual channel 32, which extends from the inlet (exit of the sub-manifold 5*a*) for the liquid from the sub-manifold 5*a* to the ejection orifice 8. A liquid supplied to the sub-manifold 5*a* is ejected from the ejection orifice 8 through the path described below. First, the liquid from the sub-manifold 5*a* flows upward through the individual supply channel 6 to one end of the aperture 12. The liquid then horizontally flows in the direction in which the aperture 12 extends, and reaches the other end of the aperture 12. The liquid then flows upward to one end of the pressurizing chamber 10. The liquid flows horizontally in the direction in which the pressurizing chamber 10 extends, and reaches the other end of the pressurizing chamber 10. While gradually moving horizontally, the liquid flows substantially downward to the ejection orifice 8, which is open in the lower surface. The liquid is then ejected through the ejection orifice 8.

As shown in FIG. 5A, the piezoelectric actuator substrate 21 has a stacked structure including two piezoelectric ceramic layers 21*a* and 21*b*. These piezoelectric ceramic layers 21*a* and 21*b* each have a thickness of about 20 μm. The displacement element 50, which is a displaceable part of the piezoelectric actuator substrate 21, has a thickness of about 40 μm, which is not greater than 100 μm. The displacement element 50 can thus be displaced more. Both the piezoelectric ceramic layers 21*a* and 21*b* extend across multiple pressurizing chambers 10 (refer to FIG. 3). These piezoelectric ceramic layers 21*a* and 21*b* are formed from, for example, a ferroelectric lead zirconate titanate (PZT) ceramic material.

The piezoelectric actuator substrate 21 includes a common electrode 34, which is formed from, for example, a Ag—Pd-based metal material, and an individual electrode 35, which is formed from, for example, a Au-based metal material. As described above, the individual electrode 35 is located on the upper surface of the piezoelectric actuator substrate 21 at a position corresponding to the pressurizing chamber 10. The individual electrode 35 includes an individual electrode body 35*a*, which is located at a position corresponding to the pressurizing chamber 10, and an extraction electrode 35*b*, which is drawn out of the area corresponding to the pressurizing chamber 10.

The piezoelectric ceramic layers 21*a* and 21*b* and the common electrode 34 have substantially the same shape. The piezoelectric ceramic layers 21*a* and 21*b* and the common electrode 34 warp less when fired together. One layer having substantially the same shape as another herein refers to the shape having outer periphery dimensions different from the other within 1% of its width. The piezoelectric actuator substrate 21 may allow only warps that fall within the thickness of the piezoelectric actuator substrate 21. To reduce warps caused by a difference in firing contraction between parts with and without an electrode inside the piezoelectric actuator substrate 21, the common electrode 34 is formed entirely with no internal patterns. The outer peripheries of the piezoelectric ceramic layers 21*a* and 21*b*, which are basically overlaid before fired and then cut together, are aligned within the range of the processing accuracy. Any common electrode 34 printed entirely and then cut concurrently with the piezoelectric ceramic layers 21*a* and 21*b* warps less. In addition, a common electrode 34 printed in a pattern similar to and slightly smaller than the piezoelectric ceramic layers 21*a* and 21*b* is prevented from being uncovered on the side surfaces of the piezoelectric actuator substrate 21, and thus has high electrical reliability.

Although described in detail later, each individual electrode 35 receives a driving signal (driving voltage) from the controller 88 through a flexible printed circuit (FPC), which is external wiring. The driving signal is transmitted periodically in synchronization with the transport speed of the print paper P. The common electrode 34 is formed substantially in the entire area across a plane between the piezoelectric ceramic layers 21*a* and 21*b*. More specifically, the common electrode 34 extends over all the pressurizing chambers 10 in the area facing the corresponding piezoelectric actuator substrate 21. The common electrode 34 has a thickness of about 2 μm. The common electrode 34 is grounded in an area (not shown) and held at the ground potential. In the present embodiment, a surface electrode (not shown) different from the individual electrodes 35 is formed on the piezoelectric ceramic layer 21*b* in parts around an electrode group including the individual electrodes 35. The surface electrode is electrically connected to the common electrode 34 via a through-hole formed in the piezoelectric ceramic layer 21*b*, and connected to external wiring, similarly to the large number of individual electrodes 35.

As described later, in response to a predetermined driving signal that is selectively provided to each individual electrode 35, the pressure is applied to the liquid in the pressurizing chamber 10 corresponding to the individual electrode 35. Thus, droplets are ejected through the corresponding ejection orifice 8 via the individual channel 32. More specifically, the piezoelectric actuator substrate 21 includes the individual displacement element 50 (actuator) in its part facing each pressurizing chamber 10. The piezoelectric actuator substrate 21 is intended for the corresponding pressurizing chamber 10 and the ejection orifice 8. More specifically, the piezoelectric ceramic layer 21*a*, the common electrode 34, the piezoelectric ceramic layer 21*b*, and the individual electrode 35, which are located immediately above each pressurizing chamber 10, form the displacement element 50 having the unit structure shown in FIG. 5A. The laminate of the two piezoelectric ceramic layers 21*a* and 21*b* includes the displacement element 50 for each pressurizing chamber 10. The piezoelectric actuator substrate 21 thus includes multiple displacement elements 50 that function as pressurizers for pressurizing the pressurizing chambers 10. In the present embodiment, the amount of liquid ejected from the ejection orifice 8 in a single ejection operation is about 5 to 7 picoliters (pL).

When the piezoelectric actuator substrate 21 is viewed from above, the individual electrode body 35*a* overlaps the pressurizing chamber 10. The part of the piezoelectric ceramic layer 21*b* located in the middle of the pressurizing chamber 10 and held between the individual electrode 35 and the common electrode 34 is polarized in the stacked direction of the piezoelectric actuator substrate 21. The piezoelectric ceramic layer 21*b* may be polarized in either an upward direction or a downward direction, and can be driven with a driving signal in accordance with the direction.

As shown in FIG. 5A, the common electrode 34 and the individual electrode 35 hold only the uppermost layer or the piezoelectric ceramic layer 21*b* between them. The area of the piezoelectric ceramic layer 21*b* held between the individual electrode 35 and the common electrode 34 is referred to as an active area. The piezoelectric ceramic in the active area is polarized in the thickness direction. In the piezoelectric actuator substrate 21 according to the present embodiment, only the uppermost piezoelectric ceramic layer 21*b* includes the active area. The piezoelectric ceramic layer 21*a* including no active area serves as a diaphragm. The piezoelectric actuator substrate 21 has a unimorph structure.

A driving procedure used in the present embodiment will now be described. The individual electrode 35 has its initial potential higher than the potential of the common electrode 34 (hereafter referred to as a high potential). In this state, the displacement element 50 deforms outward toward the pressurizing chamber 10. The pressurizing chamber 10 thus has a smaller capacity. When an ejection is requested, the potential of the individual electrode 35 is lowered to the same potential as the common electrode 34 (hereafter referred to as a low potential). The displacement element 50 then returns to the initial (flat) shape. The pressurizing chamber 10 thus has a larger capacity. The larger capacity generates a negative pressure in the pressurizing chamber 10, which sucks the liquid into the pressurizing chamber 10 from the manifold 5. Subsequently, the potential of the individual electrode 35 returns to the high potential at predetermined timing. The displacement element 50 then deforms outward toward the pressurizing chamber 10. The pressurizing chamber 10 thus has a smaller capacity. This increases the pressure in the pressurizing chamber 10, thus ejecting droplets. In this manner, a driving signal including a pulse at the high potential is provided to the individual electrode 35, thus ejecting the liquid. The pulse ideally has the pulse width of the acoustic length (AL), which is the time length for which a pressure wave propagates from the manifold 5 to the ejection orifice 8 in the pressurizing chamber 10. The pulse causes droplets to be ejected with a higher pressure with the combination of the negative pressure and the positive pressure when the pressurizing chamber 10 is switched from under the negative pressure to the positive pressure.

The nozzle plate 31 will now be described in detail as one example of the nozzle member according to the disclosure. FIG. 5B is a cross-sectional view of a part of the channel 4 including the ejection orifice 8. FIG. 5C is a further enlarged cross-sectional view of a part including the ejection orifice surface 4-1 in FIG. 5B. In FIGS. 5B and 5C, the unevenness near the ejection orifice surface 4-1 is exaggerated from the actual scale.

The nozzle plate 31 described below is assumed to have the ejection orifice surface 4-1 as the upper side. The nozzle plate 31 includes a base 60, a plating film 61, and a combination film 68.

The base 60 includes a first surface 60*a* as an outer surface of the channel 4 and a second surface 60*b* opposite to the first surface 60*a*. The base 60 has through-holes 8*a* extending between the first surface 60*a* and the second surface 60*b*.

The plating film 61 almost entirely covers the base 60. The combination film 68 covers the plating film 61 on the first surface 60*a* of the base 60. The combination film 68 includes a metal film 62, a metal oxide film 63, and a water-repellent film 64 stacked in this order from the plating film 61. The upper surface of the water-repellent film 64 is the ejection orifice surface 4-1.

The plating film 61 also covers the inner walls of the through-holes 8*a*. Each through-hole 8*a* is a hole formed in the base 60. The through-hole 8*a* may have a film such as the plating film 61 or the combination film 68 formed on its inner wall to serve as the ejection orifice 8 defined inside. When the through-hole 8*a* has no film such as the plating film 61 on its inner wall, the ejection orifice 8 equates to the through-hole 8.

Although the base 60 may be a metal plate formed from, for example, stainless steel, the base 60 may also be formed from any other material. The base 60 may be, for example, an electroformed film. The electroformed film may be patterned to have the through-holes 8*a*. The base 60 obtained through electroforming can have the through-holes 8*a* with an intended shape and high accuracy. For example, the through-holes 8*a* formed by punching or laser processing may have low repeatability.

The electroformed film contains, for example, 95% or greater by mass of nickel as its main component and components other than nickel basically as impurities. The nickel content may be 98% or greater by mass, and more specifically 99% or greater by mass.

The nozzle plate 31 has a thickness of, for example, 20 to 100 μm. Each ejection orifice 8 may have a circular cross-section, but may have a cross-section with other rotationally symmetrical shapes such as an ellipse, a triangle, or a quadrangle. Each ejection orifice 8 tapers to have its diameter decreasing toward the ejection orifice surface 4-1. Each ejection orifice 8 has a tapering angle of, for example, 10 to 30 degrees. A part of each ejection orifice 8 adjacent to the ejection orifice surface 4-1 may flare and have its diameter slightly increasing toward the ejection orifice surface 4-1. The opening of each ejection orifice 8 in the ejection orifice surface 4-1 has a diameter of, for example, 10 to 200 μm.

Although nickel may be used for forming an electroformed film, nickel has relatively low acid resistance. Nickel palladium containing nickel and palladium as its main components has higher corrosion resistance to, for example, acids than nickel. The plating film 61 formed from nickel palladium may be placed as a cover metal film on the surface of the base 60 containing nickel as its main component to increase the corrosion resistance of the nozzle plate 31. The plating film 61 may have a palladium content of 60% or greater by mass, specifically 70% or greater by mass, and more specifically 85% or greater by mass. The plating film 61 having a higher palladium content has higher corrosion resistance. The plating film 61 may have a nickel content of 2% or greater by mass, and specifically 5% or greater by mass. The plating film 61 having a lower palladium content and a higher nickel content increases the bonding strength between the plating film 61 and the base 60, and reduces cost with nickel, which is less expensive than palladium.

Containing nickel and palladium as main components refers to the total of the nickel content and the palladium content being 80% or greater by mass. The total of the nickel content and the palladium content may be specifically 95% or greater by mass, and more specifically 99% or greater by mass.

The ejection orifice 8 is a part of the individual channel 32 formed in the channel 4. The flow channel continuous with the ejection orifice 8 in the nozzle plate 31 connects to the pressurizing chamber 10. The flow channel continuous with the ejection orifice 8 is larger than the ejection orifice 8, and thus the second surface 60*b* of the nozzle plate 31 faces the individual channel 32 around the through-hole 8*a*. The plating film 61 may cover the entire area facing the individual channel 32 to prevent corrosion. The plating film 61 may almost entirely cover the base 60. The plating film 61 may be eliminated when the base 60 does not corrode with the liquid to be used.

The plating film 61 may have a thickness of 0.1 μm or greater, and specifically 0.5 μm or greater. The base 60 covered by the plating film 61 having a greater thickness is less likely to corrode with the liquid reaching the base 60. The plating film 61 may have a thickness of 5 μm or less, and specifically 3 μm or less. The plating film 61 having a smaller thickness is less likely to have varying thicknesses, and thus is less likely to increase the shape variations of the ejection orifice 8, and the unevenness of the ejection orifice surface 4-1.

The water-repellent film 64 covers the ejection orifice surface 4-1 of the nozzle plate 31 to increase the contact angle with the liquid to be used. Although the film 64 is water-repellent in this example for ease of explanation, the film 64 may be repellent to any liquid to be used other than water-based liquid.

The water-repellent film 64 covering the metal oxide film 63 achieves a higher bonding strength, and thus does not easily peel off. The water-repellent film 64 may be, for example, a film of fluororesin containing silanol groups, a silicon-based water-repellent film, polytetrafluoroethylene, or eutectoid nickel plating. The water-repellent film 64 formed on the metal oxide film 63 has more bonds between the metal oxide film 63 and the water-repellent film 64, thus increasing the bonding strength. For example, the water-repellent film 64 using fluororesin containing silanol groups has more bonds between the water-repellent film 64 and the metal oxide film 63 due to dehydration and polymerization.

The physical effect of wiping for removing the liquid on the ejection orifice surface 4-1 or the chemical effect of using a chemically active liquid, or both in combination may cause the water-repellent film 64 to peel off locally or to become thinner, thus reducing the water repellency. The water repellency has the two major roles. First, the water repellency prevents the ejected liquid from spreading from the ejection orifice 8 to the ejection orifice surface 4-1. The liquid may otherwise spread from the ejection orifice 8 to the ejection orifice surface 4-1 to disable liquid ejection in some cases or reduce the ejection rate or the amount of liquid to be ejected. Second, the water repellency prevents the mist of the ejected liquid adhering to the ejection orifice surface 4-1 from spreading on the ejection orifice surface 4-1 and reaching the ejection orifice 8. The liquid spreading on the ejection orifice surface 4-1 and reaching the ejection orifice 8 can connect to the meniscus in the ejection orifice 8 to disable liquid ejection or cause liquid ejection in a wrong direction.

In any case, the ejection orifice surface 4-1 includes a first area A1 around the ejection orifice 8, in which high water repellency is to be maintained, and also includes a second area A2 between adjacent ejection orifices 8, in which high water repellency is to be basically maintained. However, maintaining the initial water repellency without any change is difficult. The water repellency of the water-repellent film 64, which cannot avoid deteriorating as the liquid ejection head 2 is used, deteriorates faster in the second area A2 than in the first area A1. This maintains relatively high water repellency in the first area A1, and allows the mist adhering to the second area A2 to accumulate in the second area A2 having lower repellency. The liquid does not easily spread to the first area A1.

To allow the water repellency to deteriorate slower in the first area A1 than in the second area A2, the bonding strength between the water-repellent film 64 and the metal oxide film 63 is higher in the first area A1 than in the second area A2. More specifically, either or both the two designs may be used. One is to form the metal oxide film 63 with a greater thickness (thicker) in the first area A1 than in the second area A2. The other is to form the metal oxide film 63 with a rougher surface adjacent to the water-repellent film 64 in the first area A1 than in the second area A2.

The first area A1 of the ejection orifice surface 4-1 extends outward from the edge of the ejection orifice 8 by the opening radius of the ejection orifice 8 in the ejection orifice surface 4-1. The first area A1 having a greater thickness refers to the first area A1 including a thicker part. The entire first area A1 may not be thicker. The first area A1 being rougher refers to the first area A1 including a rougher part. The entire first area A1 may not be rougher. The thicker or rougher part of the first area A1 may not be annular to surround the ejection orifice 8. The second area A2 is located between adjacent first areas A1. The thickness or roughness of the metal oxide film 63 in the second area A2 may be measured at the midpoint between the adjacent first areas A1 (at the midpoint between the adjacent ejection orifices 8).

In the present embodiment, the metal oxide film 63 is thickest at positions slightly outward from the edge of the ejection orifice 8. The thickness of the metal oxide film 63 decreases gradually away from the ejection orifice 8, and is substantially uniform at positions outward from a predetermined point. Likewise, the surface of the metal oxide film 63 adjacent to the water-repellent film 64 is roughest at positions surrounding the ejection orifice 8. The surface roughness decreases gradually at positions outward from the ejection orifice 8, and is substantially uniform at positions outward from a predetermined point.

The surface roughness of the metal oxide film 63 adjacent to the water-repellent film 64 can be measured after the water-repellent film 64 is removed by, for example, chemical processing. The water-repellent film 64 is formed in conformance with the surface of the underlying metal oxide film 63. Thus, the surface roughness of the water-repellent film 64 may be measured to determine the surface roughness of the metal oxide film 63 adjacent to the water-repellent film 64.

To strengthen the bonding between the metal oxide film 63 and the base 60 or the plating film 61, the metal film 62 is located between the metal oxide film 63 and the base 60 or the plating film 61. The metal film 62 may be formed by, for example, sputtering. The metal film 62 is formed from, for example, at least one of Ti, Ta, Si, and Nb. The metal film 62 contains 95% or greater by mass of such metallic elements, and other components basically as impurities. The metal film 62 may contain 98% or greater by mass, and specifically 99% or greater by mass of such metallic elements. The metal oxide film 63 is firmly bonded to the base 60 or the plating film 61 by metallic bonding.

The metal oxide film 63 is formed on the metal film 62 by, for example, sputtering. The metal oxide film 63 may contain, as a metal component, for example, at least one of Ti, Ta, Si, and Nb. An oxide film containing such metallic elements has relatively high corrosion resistance to acidic or alkaline ink, and also achieves a higher bonding strength between the oxide film and the water-repellent film 64. The metal oxide film 63 contains 95% or greater by mass of such metallic elements, excluding oxygen, and other components basically as impurities. The metal oxide film 63 may contain 98% or greater by mass, and specifically 99% or greater by mass of such metallic elements, excluding oxygen.

To form the metal oxide film 63, a metallic element and oxygen are supplied concurrently. The supplied oxygen combines with the concurrently supplied metallic element to form the metal oxide film 63. Additionally, the supplied oxygen partially oxidizes a portion of the existing metal film 62 into the metal oxide film 63 under a modified condition. With air flowing through the through-hole 8*a*, the partial oxidation of the metal film 62 into the metal oxide film 63 can progress faster in the first area A1 than in the second area A2. This forms the metal film 62 thinner in the first area A1 than in the second area A2, and forms the metal oxide film 63 thicker in the first area A1 than in the second area A2. The metal oxide film 63 may be formed thicker in the first area A1 by oxygen plasma treatment, which will be described later.

When the metal film 62 and the metal oxide film 63 contain the same metal as their main component, the metal film 62 and the metal oxide film 63 will have stronger bonding. In this case, the metal film 62 also oxidizes easily through the metal oxide film 63. The metal film 62 can partially oxidize and increase its volume into the metal oxide film 63, without causing inconsistency between the metal film 62 and the metal oxide film 63.

The metal film 62 can undergo surface oxidization due to the surrounding oxygen in the air depending on its material, thus forming an oxide film rather than the intended metal oxide film 63. However, such an oxide film is thin and insufficiently strengthens the bonding to the water-repellent film 64, and has a substantially uniform thickness. The oxide film cannot produce the same effect as the metal oxide film 63 in the nozzle component according to the disclosure. The metal oxide film 63 according to the disclosure is designed to have a thickness of, for example, 10 nm or greater to strengthen the bonding to the water-repellent film 64, and is selectively thicker around the nozzle. The metal oxide film 63 differs from a naturally occurring oxide film having a substantially uniform thickness (e.g., about 5 nm or less).

The nozzle plate 31 may be subjected to oxygen plasma treatment before the water-repellent film 64 is formed. The oxygen plasma treatment is used to remove organic or other matter on the metal oxide film 63 by oxidation. Additionally, the metal film 62 may be partially oxidized into the metal oxide film 63 under a modified condition. With air flowing through the through-hole 8*a*, the partial oxidation can progress faster in the first area A1 than in the second area A2. This forms the metal film 62 thinner in the first area A1 than in the second area A2, and the metal oxide film 63 thicker in the first area A1 than in the second area A2.

When the metal oxide film 63 is formed thicker in the first area A1 than in the second area A2 through the processes described above, the surface of the metal oxide film 63 adjacent to the water-repellent film 64 becomes rougher in the first area A1 than in the second area A2. The surface roughness increases toward the ejection orifice 8. This is seemingly caused by the metal film 62 partially increasing its volume into the metal oxide film 63 and deforming and pushing the metal oxide film 63 upward. The metal film 62 has a larger part forming into the metal oxide film 63 at a position nearer the ejection orifice 8. This seemingly increases the surface roughness toward the ejection orifice 8.

When the metal oxide film 63 is thicker in the first area A1 than in the second area A2, the water-repellent film 64 formed on the metal oxide film 63 can be denser in the first area A1 than in the second area A2. The resultant water-repellent film 64 can thus have higher water repellency in the first area A1 than in the second area A2. The water-repellent film 64 can thus have higher water repellency near the ejection orifice 8 than in other areas in the ejection orifice surface 4-1 before the water-repellent film 64 deteriorates. This reduces deterioration of the ejection performance caused by liquid adhering near the ejection orifice 8 in the ejection orifice surface 4-1. The higher water repellency of the water-repellent film 64 in the first area A1 than in the second area A2 can be determined by the contact angle with pure water on the surface of the water-repellent film 64 larger in the first area A1 than in the second area A2. The contact angles can be measured using a commercially available contact angle meter.

Through the above processes, the metal oxide film 63 can have a thickness of 10 to 50 nm in the second area A2, forming a thicker area around the ejection orifice 8. The thicker area of the metal oxide film 63 may extend from the edge of the ejection orifice 8 by the opening radius of the ejection orifice 8 or greater in the ejection orifice surface 4-1. For a circular ejection orifice 8 having an opening radius of 10 μm for example, the area of the metal oxide film 63 within 10 μm from the edge of the ejection orifice 8, or more specifically the entire area of the metal oxide film 63 excluding the ejection orifice 8 within 20 μm from the center of the ejection orifice 8, may be thicker than in the second area A2. The metal oxide film 63 within 20 μm or less from the center of the ejection orifice 8 can be thicker than in the second area A2 by 10 to 100 nm. The area of the metal oxide film 63 thicker than in the second area A2 may extend from the edge of the ejection orifice 8 by up to 200 μm. The thickest area of the metal oxide film 63 may have a thickness of 50 to 200 nm.

The area of the metal oxide film 63 having a surface roughness greater than in the second area A2 at its surface adjacent to the water-repellent film 64 substantially equates to the area of the metal oxide film 63 thicker than in the second area A2. The metal oxide film 63 can thus have a surface roughness of 1 to 5 nm in the second area A2 at its surface adjacent to the water-repellent film 64, forming an area with a still greater roughness around the ejection orifice 8. The rougher area at the surface of the metal oxide film 63 adjacent to the water-repellent film 64 may extend from the edge of the ejection orifice 8 by the opening radius or greater of the ejection orifice 8 in the ejection orifice surface 4-1. In the entire area excluding the ejection orifice 8 within 20 μm from the center of the ejection orifice 8, the metal oxide film 63 may have a greater surface roughness at its surface adjacent to the water-repellent film 64 than in the second area A2. The metal oxide film 63 has the surface roughness at its surface having a greater surface roughness adjacent to the water-repellent film 64 higher than in the second area A2 by 4 to 50 nm. The area of the metal oxide film 63 having a surface roughness at its surface adjacent to the water-repellent film 64 greater than in the second area A2 may extend from the edge of the ejection orifice 8 by up to 200 The metal oxide film 63 may have a surface roughness of 5 to 51 nm at its surface adjacent to the water-repellent film 64.

The area of the metal film 62 thinner than in the second area A2 substantially equates to the area of the metal oxide film 63 thicker than in the second area A2. The metal film 62 in the second area A2 may have a thickness of 20 to 200 nm. In addition, the metal film 62 may be still thinner around the ejection orifice 8. The thinner area of the metal film 62 may extend from the edge of the ejection orifice 8 by the opening radius or greater of the ejection orifice 8 in the ejection orifice surface 4-1. The entire area excluding the ejection orifice 8 within 20 μm from the center of the ejection orifice 8 may have a thickness of the metal film 62 smaller than in the second area A2 by 10 to 150 nm. The area of the metal film 62 thinner than in the second area A2 may extend from the edge of the ejection orifice 8 by up to 200 μm. The thinnest area of the metal film 62 may have a thickness of 10 to 190 nm.

As the metal oxide film 63 becomes thicker, more bonds with the water-repellent film 64 form to strengthen the bonding with the water-repellent film 64. The water repellency thus deteriorates slower in the first area A1 than in the second area A2, extending the service life of the nozzle plate 31.

As the surface of the metal oxide film 63 adjacent to the water-repellent film 64 becomes rougher, the bonding with the water-repellent film 64 increases to improve the bonding strength of the water-repellent film 64. The water repellency thus deteriorates slower in the first area A1 than in the second area A2, extending the service life of the nozzle plate 31.

The thickness of the metal oxide film 63 or the bonding strength of the water-repellent film 64 has the relationship below with the decrease in the contact angle caused by local peeling of the water-repellent film 64 or by other factors. For a metal oxide film 63 having a thickness of 10 nm, the water-repellent film 64 has a bonding strength of about 300 μN. After wiping is repeated a predetermined number of times, the contact angle with the water-repellent film 64 decreases by about 40 degrees. For a metal oxide film 63 having a thickness of 50 nm, the water-repellent film 64 has a bonding strength of about 800 μN. Under the same conditions, the contact angle decreases with the water-repellent film 64 by about 5 degrees after wiping.

A first nozzle member according to the disclosure includes a base 60, a metal oxide film 63, and a water-repellent film 64. The base 60 includes a first surface 60*a* having a plurality of through-holes 8*a* as ejection orifices 8. The metal oxide film 63 is located on the first surface 60*a*. The water-repellent film 64 is located on the metal oxide film 63. The metal oxide film 63 has a greater thickness in a first area A1 than in a second area A2. The first area A1 is an area surrounding an ejection orifice 8. The second area A2 is an area between adjacent first areas A1. This is the basic structure of the first nozzle member according to the disclosure. The other components are not essential, and may be changed as appropriate. This structure reduces deterioration of the ejection performance caused by liquid adhesion near the ejection orifice 8.

A second nozzle member according to the disclosure includes a base 60, a metal oxide film 63, and a water-repellent film 64. The base 60 includes a first surface 60*a* having a plurality of through-holes 8*a* as ejection orifices 8. The metal oxide film 63 is located on the first surface 60*a*. The water-repellent film 64 is located on the metal oxide film 63. The metal oxide film 63 has a greater surface roughness in a first area A1 than in a second area A2 at its surface adjacent to the water-repellent film 64. The first area A1 is an area surrounding an ejection orifice 8. The second area A2 is an area between adjacent first areas A1. This is the basic structure of the second nozzle member according to the disclosure. The other components are not essential, and may be changed as appropriate. This structure reduces deterioration of the ejection performance caused by liquid adhesion near the ejection orifice 8.

The nozzle member according to the disclosure may further include a metal film 62 between the metal oxide film 63 and the base 60. This structure improves the bonding strength between the metal oxide film 63 and the base 60.

In the nozzle member according to the disclosure, the metal film 62 and the metal oxide film 63 may contain the same metal as their main components. This allows the metal film 62 and the metal oxide film 63 to be firmly bonded with each other.

In the nozzle member according to the disclosure, the water-repellent film 64 may have a higher water repellency in the first area A1 than in the second area A2. This structure reduces deterioration of the ejection performance caused by liquid adhesion near the ejection orifice 8.

As described above, a liquid ejection head according to the disclosure includes a nozzle member according to the disclosure, a pressurizing chamber 10 communicating with each ejection orifice 8, and a pressurizer (displacement elements 50) that pressurizes the pressurizing chamber 10. This is the basic structure of the liquid ejection head according to the disclosure. The other components are not essential, and may be changed as appropriate. This structure of the liquid ejection head reduces deterioration of the ejection performance caused by liquid adhesion near an ejection orifice 8.

A method for manufacturing the nozzle plate 31 will now be described. An electroforming substrate formed from a metal such as stainless steel is prepared first. Then, a negative photoresist film is formed on the electroforming substrate.

A photomask having a mask pattern designed to form the through-holes 8*a* of the intended dimensions and arrangement is prepared. The photoresist film is exposed to light through the photomask. The photomask allows light to pass through in parts forming the through-holes 8*a*. The parts of the photoresist film that receive light can cure. Uncured parts are then dissolved and removed with a developer to leave cured parts.

Subsequently, the electroforming substrate is plated with nickel to form an electroformed film, which serves as the base 60. The electroformed film is not formed in the parts with the cured photoresist film being left. These parts form the through-holes 8*a*. The photoresist film inside the through-holes 8*a* are removed using an agent such as an organic solvent. The electroformed film is then removed from the electroforming substrate to complete the base 60 having the through-holes 8*a*.

The entire base 60 is then plated with nickel and palladium to form the plating film 61.

The metal film 62 of Ta is formed on the first surface 60*a* of the plating film 61 (the surface adjacent to the ejection orifice surface 4-1) by sputtering. To form the metal film 62 with a substantially uniform thickness, this process is performed under conditions in which the through-hole 8*a* is closed on its end at the second surface 60*b* and air cannot flow in the through-hole 8*a*.

Subsequently, Ta and oxygen are supplied onto the metal film 62 to form the metal oxide film 63 by sputtering. When the supplied Ta and oxygen form the metal oxide film 63, the partial pressures of the supplied elements and the sputtering voltage are adjusted to form a part of the metal film 62 into the metal oxide film 63. This process is performed under conditions in which the through-hole 8*a* is open at its end at the second surface 60*b* and air can flow in the through-hole 8*a*. This forms a larger part of the metal film 62 into the metal oxide film 63 in the first area A1 surrounding the through-hole 8*a* than in the second area A2.

Subsequently, the metal oxide film 63 is subjected to oxygen plasma treatment to remove organic or other matter on the surface of the metal oxide film 63 by oxidation. The partial pressure of the oxygen and the voltage are also adjusted to form a part of the metal film 62 into the metal oxide film 63. This process is performed under conditions in which the through-hole 8*a* is open at its end at the second surface 60*b* and air can flow in the through-hole 8*a*. This forms a larger part of the metal film 62 into the metal oxide film 63 in the first area A1 surrounding the through-hole 8*a* than in the second area A2.

Although forming the metal oxide film 63 thicker in the first area A1 may be achieved either by performing oxygen plasma treatment or by forming the metal oxide film 63, or preferably by both the processes.

The water-repellent film 64 is then formed using a fluorocarbon water repellent to complete the nozzle plate 31.

REFERENCE SIGNS LIST

1 printer
2 liquid ejection head

4 channel
4-1 ejection orifice surface
5 manifold
5*a* sub-manifold
5*b* manifold opening
6 individual supply channel
8 ejection orifice (nozzle)
8*a* through-hole
9 pressurizing chamber group
10 pressurizing chamber
11*a*, 11*b*, 11*c*, 11*d* pressurizing chamber row
12 aperture
13 head body
15*a*, 15*b*, 15*c*, and 15*d* ejection orifice row
21 piezoelectric actuator substrate
21*a* piezoelectric ceramic layer (ceramic diaphragm)
21*b* piezoelectric ceramic layer
22 to 30 plate
31 plate (nozzle member)
32 individual channel
34 common electrode
35 individual electrode
35*a* individual electrode body
35*b* extraction electrode
50 displacement element
60 base (of nozzle plate)
60*a* first surface
60*b* second surface
61 plating film
62 metal film
63 metal oxide film
64 water-repellent film
68 combination film
70 head mount frame
72 head group
80A feed roller
80B rewind roller
82A guide roller
82B transport roller
88 controller
P print paper

The invention claimed is:

1. A nozzle member, comprising:
a base including a first surface having a plurality of through-holes as ejection orifices;
a metal oxide film located on the first surface; and
a water-repellent film located on the metal oxide film,
wherein the metal oxide film has a greater thickness in a first area than in a second area, the first area is an area surrounding each ejection orifice, and the second area is an area between adjacent first areas.

2. The nozzle member according to claim 1, wherein the metal oxide film has a greater surface roughness in the first area than in the second area at a surface of the metal oxide film adjacent to the water-repellent film.

3. The nozzle member according to claim 1, further comprising:
a metal film, which is located between the metal oxide film and the base.

4. The nozzle member according to claim 3, wherein
the metal film and the metal oxide film comprise the same metal as a main component.

5. The nozzle member according to claim 3, wherein
the metal film has a smaller thickness in the first area than in the second area.

6. The nozzle member according to claim 1, wherein
the water-repellent film has a higher water repellency in the first area than in the second area.

7. A liquid ejection head, comprising:
the nozzle member according to claim 1;
a pressurizing chamber communicating with each ejection orifice; and
a pressurizer configured to pressurize the pressurizing chamber.

8. A recording device, comprising:
the liquid ejection head according to claim 7;
a transport unit configured to transport a recording medium to the liquid ejection head; and
a controller configured to control the liquid ejection head.

9. A nozzle member, comprising:
a base including a first surface having a plurality of through-holes as ejection orifices;
a metal oxide film located on the first surface; and
a water-repellent film located on the metal oxide film,
wherein the metal oxide film has a greater surface roughness in a first area than in a second area at a surface of the metal oxide film adjacent to the water-repellent film, the first area is an area surrounding each ejection orifice, and the second area is an area between adjacent first areas.

10. The nozzle member according to claim 9, further comprising:
a metal film, which is located between the metal oxide film and the base.

11. The nozzle member according to claim 10, wherein
the metal film and the metal oxide film comprise the same metal as a main component.

12. The nozzle member according to claim 10, wherein
the metal film has a smaller thickness in the first area than in the second area.

13. The nozzle member according to claim 9, wherein
the water-repellent film has a higher water repellency in the first area than in the second area.

14. A liquid ejection head, comprising:
the nozzle member according to claim 9;
a pressurizing chamber communicating with each ejection orifice; and
a pressurizer configured to pressurize the pressurizing chamber.

15. A recording device, comprising:
the liquid ejection head according to claim 14;
a transport unit configured to transport a recording medium to the liquid ejection head; and
a controller configured to control the liquid ejection head.

* * * * *